United States Patent [19]

Lampson

[11] Patent Number: 4,508,232

[45] Date of Patent: Apr. 2, 1985

[54] COUNTERBALANCED CRANE STRUCTURE

[75] Inventor: Neil F. Lampson, Kennewick, Wash.

[73] Assignee: Riggers Manufacturing Co., Kennewick, Wash.

[21] Appl. No.: 329,193

[22] Filed: Dec. 10, 1981

[51] Int. Cl.[3] ..... B66C 23/08

[52] U.S. Cl. ..... 212/178; 212/198; 212/189

[58] Field of Search ..... 280/474–475, 280/494; 212/188–189, 191–198, 223–224, 227–228, 231–232, 245, 255, 178; 114/249, 250

[56] References Cited

U.S. PATENT DOCUMENTS

| | | | |
|---|---|---|---|
| 2,179,439 | 11/1939 | Trow | 280/494 |
| 3,013,683 | 12/1961 | Harris | 280/475 |
| 3,266,817 | 8/1966 | Engstrom | 280/475 |
| 3,717,215 | 2/1973 | Nigg et al. | 280/474 |
| 3,747,718 | 7/1973 | Gauchet | 180/9.46 |
| 3,836,010 | 9/1974 | Lampson | 212/195 |
| 3,868,022 | 2/1975 | Greenlay | 212/265 |
| 4,170,309 | 10/1979 | Lampson | 212/198 |
| 4,200,306 | 4/1980 | Helms | 280/494 |
| 4,200,315 | 4/1980 | Carlsson | 280/474 |
| 4,202,453 | 5/1980 | Wilker, Jr. et al. | 212/231 |
| 4,243,148 | 1/1981 | Lampson | 212/196 |
| 4,258,852 | 3/1981 | Juergens | 212/178 |
| 4,308,699 | 1/1982 | Slysh | 52/648 |
| 4,316,548 | 2/1982 | Helm et al. | 212/196 |
| 4,358,021 | 11/1982 | Helm et al. | 212/195 |

FOREIGN PATENT DOCUMENTS

| | | | |
|---|---|---|---|
| 1140691 | 12/1962 | Fed. Rep. of Germany | 212/189 |
| 1191083 | 4/1965 | Fed. Rep. of Germany | 212/189 |
| 1241962 | 6/1967 | Fed. Rep. of Germany | 212/189 |
| 1481785 | 3/1969 | Fed. Rep. of Germany | 212/189 |
| 1810048 | 12/1969 | Fed. Rep. of Germany | 212/224 |
| 6405689 | 11/1965 | Netherlands | 212/195 |

*Primary Examiner*—Sherman D. Basinger

*Attorney, Agent, or Firm*—Wells, St. John & Roberts

[57] ABSTRACT

A windlock for selectively preventing relative pivotal movement between a mobile platform and a horizontal interconnecting stinger at the base of an elevated crane. The stinger is normally interconnected to one load platform for relative pivotal movement about the stinger central axis. Outer horizontal surfaces on the stinger structure are longitudinally movable relative to the platform to a position between adjustable screws which engage them to lock the stinger against rotational movement. This locking arrangement applies the heavy weight of a remote counterweight unit to assist in preventing lateral tipping of the load platform on which the elevated boom is supported. Outboard jacks on the platform further stabilize it against lateral tipping movements.

6 Claims, 11 Drawing Figures

FIG 2
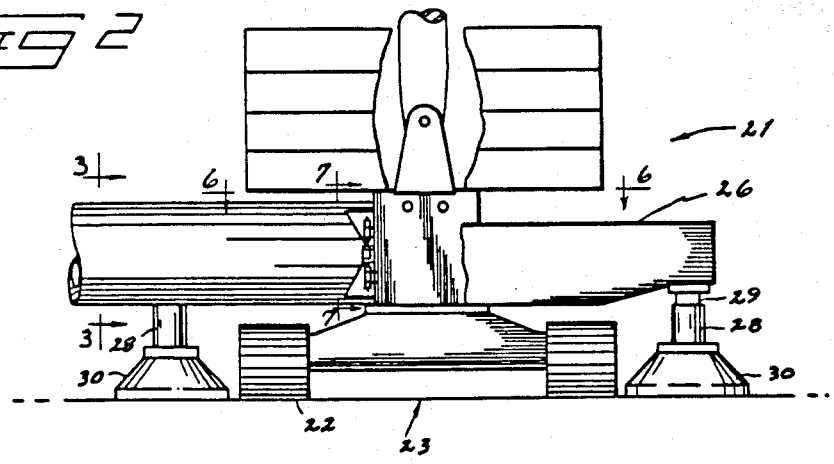
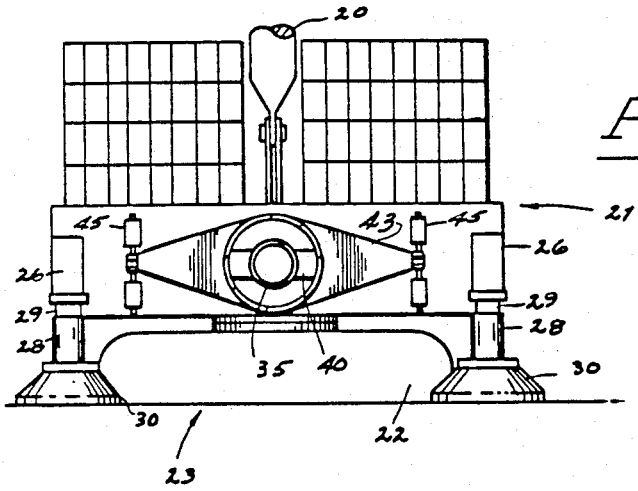
FIG 3
FIG 4
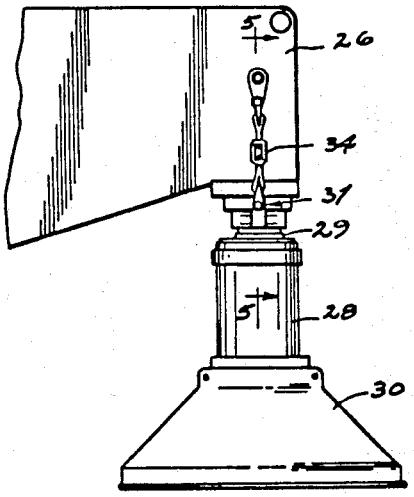

COUNTERBALANCED CRANE STRUCTURE

TECHNICAL FIELD

This invention relates to counterbalanced crane structures where a mobile counterweight is positioned at a distance from a rotating boom platform.

BACKGROUND OF THE INVENTION

The present invention comprises an improvement with respect to the basic crane structure shown in my U.S. Pat. No. 3,836,010 and applied to tower cranes in my U.S. Pat. Nos. 4,170,309 and 4,243,148. In these embodiments, a crane boom or supporting vertical tower is mounted on a pivotable load platform supported by a mobile transporter. A counterweight structure is independently supported on a second load platform pivotally carried by a second mobile transporter. The two platforms are interconnected by a rigid stinger that transmits rotational force about them during pivotal movement of the boom or tower. The platforms, transporters, and booms can be specially designed or can be constructed by using one or two conventional cranes as structural components in the compound configuration.

The cranes in question are utilized for lifting extremely high loads at substantial heights and over a substantial load radius. To make most effective use of the structural components of the crane, they are preferably longitudinally aligned in a straight row, with the upright elements in vertical positions. This aligns all of the structural components behind the load being lifted and eliminates bending forces on the structural components. The crane configurations feature high capacity lifting capability characteristic of fixed stiffleg or luffing derrick equipment, coupled with the mobility and flexibility of crawler cranes.

The structural size of such equipment exposes the cranes to the possibility of transverse wind loads which might topple with tower or boom while the crane is unattended. Since the heavy counterweight structure is remote from the load platform supporting the boom or tower, that load platform does not have the weight available which typically resists wind loading on conventional single platform crane structures. Furthermore, it is desirable that the two mobile platforms be independently pivotable about the stinger axis for ground mobility. The load platform supporting the boom or tower is therefore free to rotate about the stinger axis without any resistance from the counterweight platform.

Prior efforts to provide lateral stability to large upright booms have included the use of dual upright booms in an A-frame configuration which spreads the base below the boom. An example as shown in U.S. Pat. No. 3,868,022. Another approach is illustrated in U.S. Pat. No. 4,258,852 which uses an in-line boom and mast, and two horizontal stingers leading back to a pair of transversely spread counterweight trailers. This again is stated to provide additional lateral stability.

DESCRIPTION OF THE DRAWINGS

Two preferred embodiments of the invention are illustrated in the accompanying drawings, in which:

FIG. 2 is a fragmentary enlarged elevational view showing the counterweight unit and adjacent portions of the stinger;

FIG. 3 is a sectional view through the stinger as seen along line 3—3 in FIG. 2;

FIG. 4 is a fragmentary enlarged elevation view of a single jack assembly;

DESCRIPTION OF THE PREFERRED EMBODIMENTS

Figure 11:
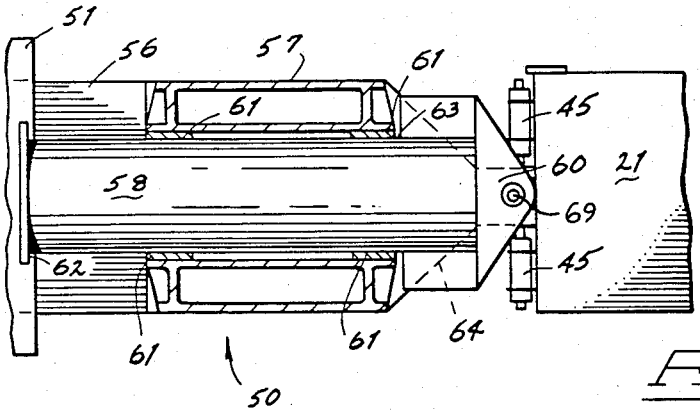
FIG. 11 is a sectional view taken along line 11—11 in FIG. 10.
Figure 9:
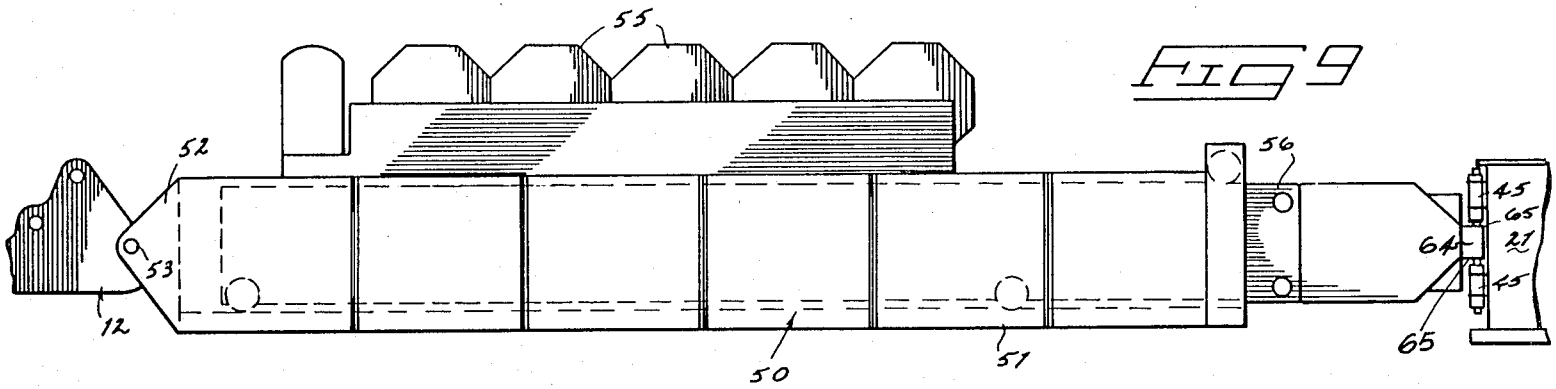
FIG. 9 is a side view of a second embodiment.
Figure 10:
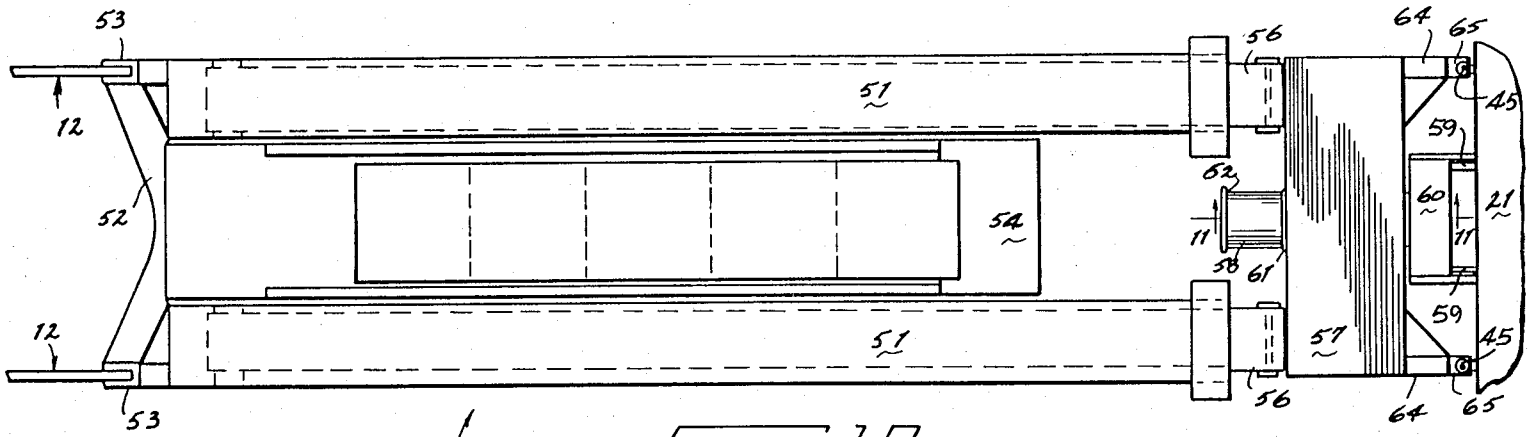
FIG. 10 is a top view of the embodiment shown in FIG. 9.

The following disclosure is submitted so as to comply with the Constitutional purposes of the Patent Laws "to promote the progress of science and useful arts" (Art. 1, Sec. 8). FIGS. 1 through 8 show details of a first embodiment. FIGS. 9 through 11 show a second embodiment of the invention applied to a telescoping stinger structure.

As shown generally in FIGS. 1 through 3 and 6, the crane basically comprises a forward crane base movably supported on a first transporter 10 and a remote rear counterweight unit supported on a second transporter 23. The frames of the transporters 10 and 23 are movably carried about the ground surface by independently powered tracks 11 and 22. Each transporter as shown has a pair of transversely spaced tracks, although wheels or multiple track assemblies can be utilized where desired.

The illustrated crane includes an upright boom 13 and a rearwardly extending upright staymast 14. Both are typically pivoted to a mobile forward load platform 13 about horizontal transverse axes. The platform 12 overlies the frame of transporter 10 and is pivotally supported on the frame about a vertical axis centered between the tracks 11. The boom 13 and staymast 14 are mounted to platform 12 for movement in unison about its center vertical axis.

The crane structure is completed by an upper jib 15, a jib strut 16, and jib suspension 17 plus the conventional boom lift topping 18.

To provide stability to the upright components of the crane, a rigid counterweight strut 20 extends upwardly from counterweight load platform 21, which is rearwardly remote from the mobile load platform 12. Platform 21 overlies the frame of a rear transporter 23, which is supported by tracks 22. It is pivotally mounted on the transporter frame for relative movement about a vertical axis centered between the tracks 22.

A rigid stinger 24 interconnects platforms 12 and 21. One form of the stinger is shown in FIGS. 1 through 8, and a second form is shown in FIGS. 9 through 11. In the first form, the stinger is cylindrical in shape and comprises one or more rigid lengths which are fixedly joined to one another to provide a stinger of preselected length depending upon the desired geometry of the crane. In the second embodiment, the stinger has a rectangular cross-sectional configuration and a telescoping ability to vary the stinger length to match lifting load requirements and space limitations at the ground level.

While the specific embodiments illustrate the crane in a configuration common to a derrick boom, it is to be understood that the present improvements can also be applied to tower-supported booms utilizing the present improvements to the stinger and counterweight unit. The term "boom" is to include vertical or angular towers and equivalent upright supports for lifting loads in conjunction with a remote counterweight unit.

Figure 1:
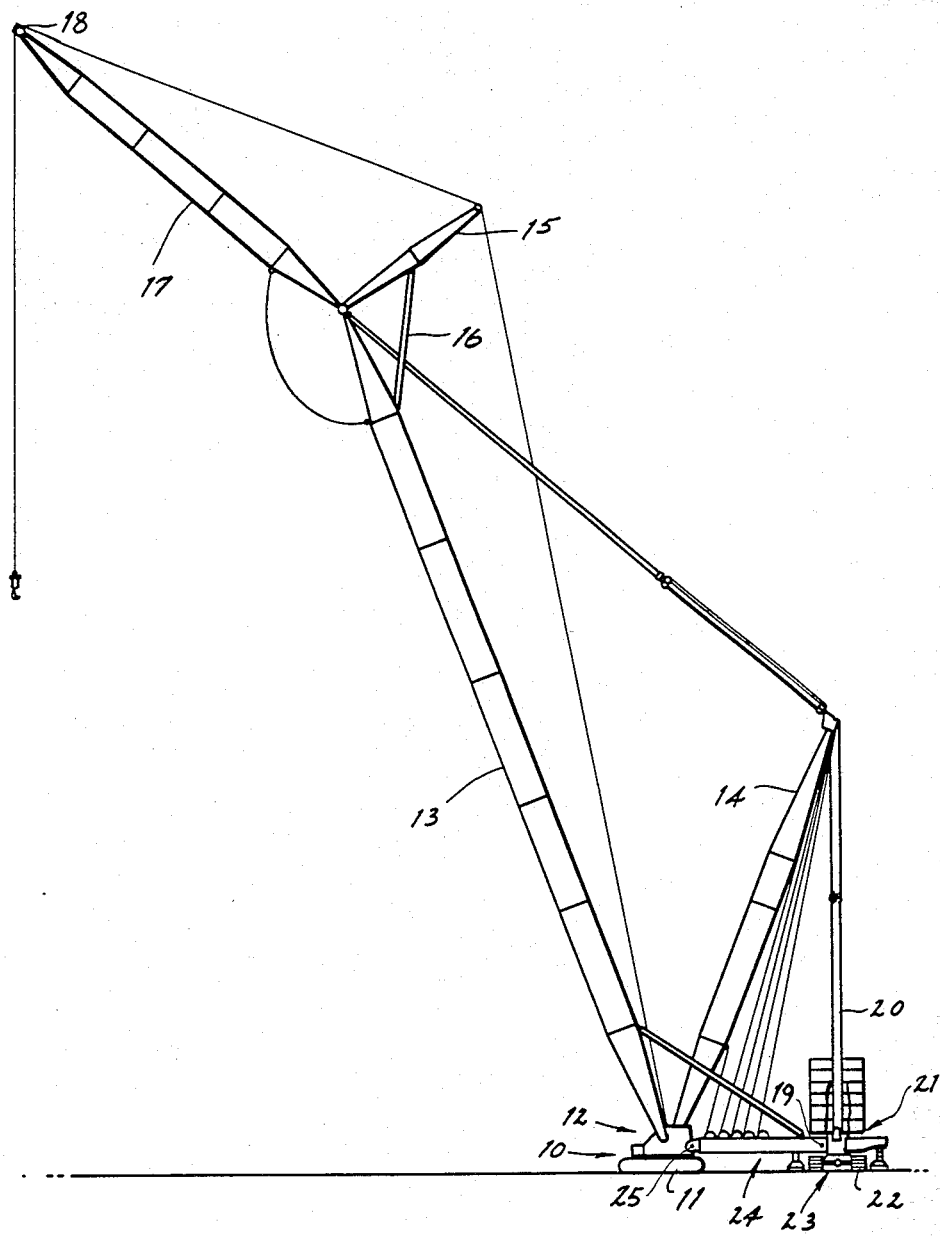
FIG. 1 is a side elevation view of an assembled crane incorporating a first embodiment.
Figure 5:
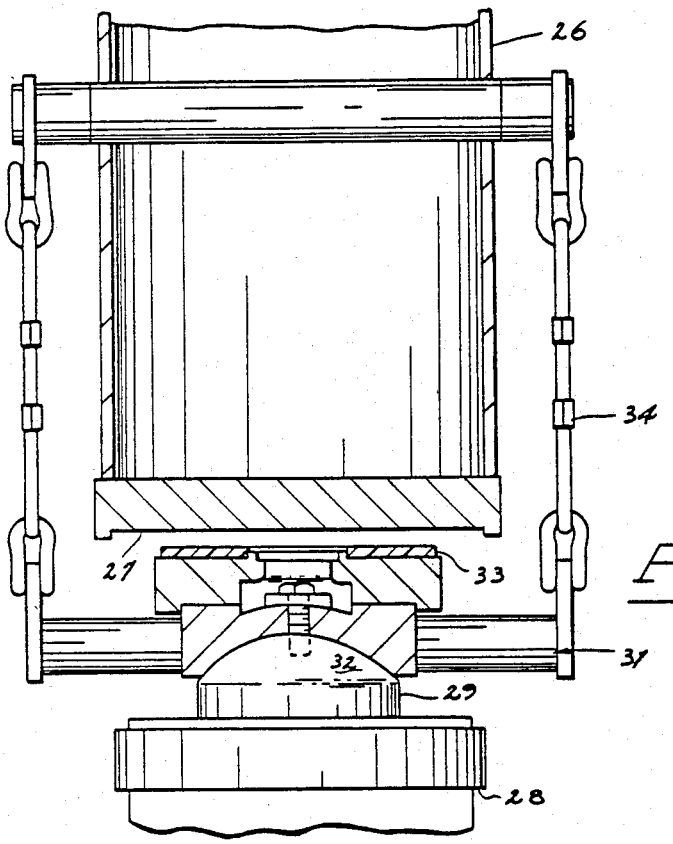
FIG. 5 is an enlarged section view taken along line 5—5 in FIG. 4.

The rigid stinger 24 extends along a longitudinal central stinger axis between platform 12 and platform 21. Its forward or inboard end is attached to platform 12 at a horizontal pivot connection shown at 25 (FIG. 1). This pivot connection permits free pivotal motion between platform 12 and stinger 24 about a horizontal axis transverse to the stinger length. The outer end of the stinger 24 is attached to platform 21 about a second horizontal pivot axis 19 parallel to the axis of the pivot connection 25. These two pivot connections permit relative changes in elevation between the mobile platforms 12 and 21 without bending or damage to the rigid stinger 24.

Means is also provided between the stinger and one of the mobile platforms to allow free pivotal movement of the stinger 24 relative to the one platform about the stinger longitudinal axis. Furthermore, the stinger members also permit relative movement between the two platforms 12 and 21 in a direction parallel to the longitudinal stinger axis. In this manner, the mobile platforms are free to accommodate speed variations and ground variations without binding of the structural connections which interconnect them in the mobile remote counterweight configuration illustrated.

Figure 6:
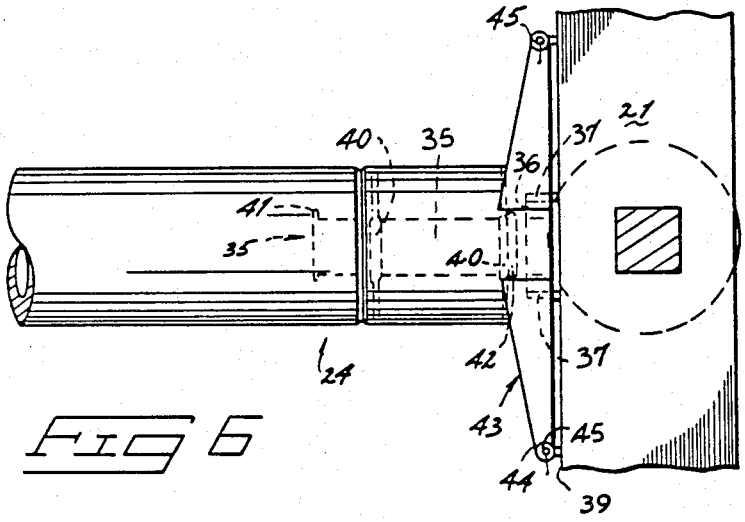
FIG. 6 is an enlarged view taken along line 6—6 in FIG 2.
Figure 7:
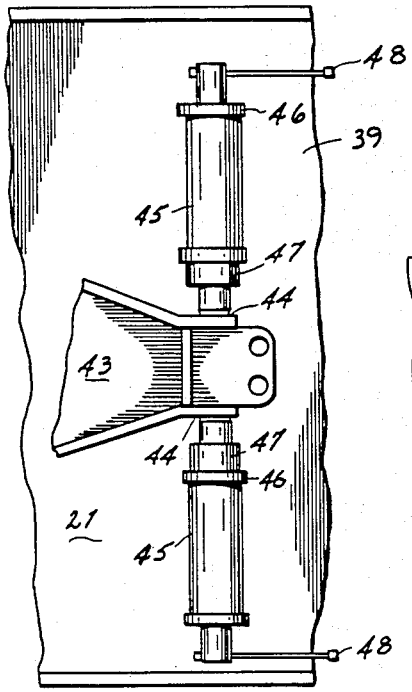
FIG. 7 is a fragmentary enlarged elevation view of the windlock screws as seen along line 7—7 in FIG. 2.
Figure 8:
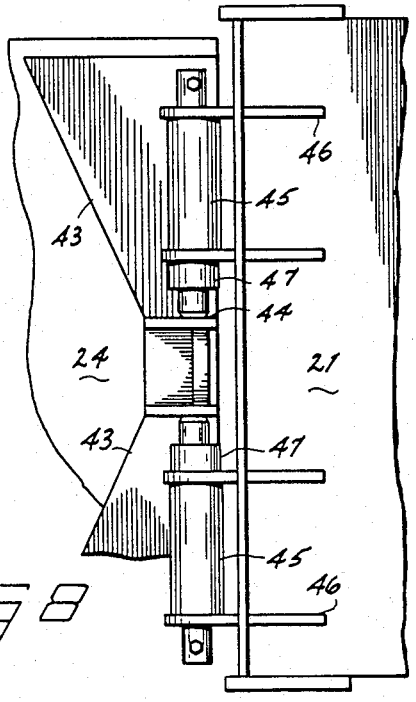
FIG. 8 is an end view of the structure in FIG. 7.

The specific details of the above stinger connections are best seen in FIGS. 2 and 6. The cylindrical outer end of stinger 24 pivotally supports a swivel tube 35 within longitudinally spaced annular bearings 40. Tube 35 is free to pivot about the longitudinal center axis of stinger 24. It also is free to slide longitudinally along the stinger axis as limited by an outer shoulder 41 and inner shoulder 42 at opposed ends of tube 35. The pivotal connection of stinger 24 to platform 21 about a transverse horizontal axis is accomplished through a yoke 36 fixed to the outer end of tube 35. Yoke 36 is pivotally connected to transverse brackets 37 on platform 21. Thus, the tube 35 mounts the outer end of stinger 24 for pivotal movement relative to platform 21 about two perpendicular axes, and further permits relative longitudinal movement between them along the longitudinal stinger axis.

The freedom of movement provided between the two mobile load platforms is desirable when moving the crane from one location to another and when lifting loads requiring mobility. However, since the heavy weight of the counterweight unit load platform is located remote from the load platform that supports the tall boom, and since the stinger 24 is normally free to pivot about its center axis relative to the counterweight, the boom is not normally balanced in a transverse direction by the weight available at the counterweight unit. Normal use of such heavy cranes does not require such transverse balancing, since the purpose of the counterweight unit is essentially to provide a rearwardly located weight to overcome the lifting forces to which the boom is subjected.

The present windlock is utilized during non-use of the crane, when it is stored with the boom in an upright position. Current procedures for protecting the crane against unexpected high wind loads are to lower the boom to the ground or to turn the boom into a position facing the expected wind. Lowering the boom is not always practical, depending upon available space limitations for extremely long boom structures. Lowering the boom also increases opportunities for vandalism or damage to the boom structure, which is more accessible at ground level. Turning the boom into the expected direction of the wind is practical only in locations where such wind direction is reasonably predictable. Obviously, changes in wind direction during the storage period cannot always be anticipated. This is particularly difficult where the crane is to be stored over an extended period of time.

Another conventional procedure for countering wind loads on the boom is to anchor the load hook to a stationary load or ground element. The main line can then be tensioned to assure a continuous vertical compressive load on the boom, which will be exerted at the load platform supporting it and will tend to counter tipping forces caused by wind. However, such a ground anchor is not always available, depending upon the nature of the terrain beneath the boom and available heavy external loads which might be used for such storage purposes.

According to the present disclosure, wind loads can be accommodated by transfer of torsional forces along stinger 24 to the counterweight platform 21. As seen in FIGS. 2, 3 and 6 through 8, the outboard end of stinger 24 is provided with two diametrically opposed horizontal arms 43 leading to outer horizontal surfaces 44 which face both upwardly and downwardly. Arms 43 are rigidly fixed to the stinger 24 and are extended radially outward from its longitudinal center axis to provide a torque arm of adequate length to counter torsional forces along the stinger.

Mounted to the adjacent upright wall 39 of the counterweight platform 21 are four upright screws 45 guided by fixed brackets 46 and threaded collars 47. The outer end of each screw 45 is provided with a perpendicular handle 48 by which the screw can be manually rotated for axial adjustment relative to brackets 46 and collars 47. The inner end of each screw 45 is adapted to bear against one of the horizontal surfaces 44 at the outer ends of the arms 43.

To lock the crane assembly for storage purposes, the mobile platforms 12 and 21 must be moved relative to one another to their minimum separation along the longitudinal center axis of stinger 24. This minimum separation is achieved when the inner shoulder 42 on swivel tube 35 abuts the inner annular bearing 40 within stinger 24 (FIG. 6). When the platforms 12 and 21 are so positioned, the outer horizontal surfaces 44 on the stinger arms 43 will be longitudinally located between the screws 45. The screws 45 can then be manually adjusted to respectively engage the surfaces 44 adjacent to them. The individual adjustment provided by the four screws 45 accommodates variations in the angular position of the arms 43 relative to platform 21, which will occur due to minor ground variations.

With the screws 45 locked against the surfaces 44 on arms 43, torsional forces along stinger 24 will be transmitted directly to the heavy counterweight platform 21. The weight of the platform 21 will therefore be directly available to counter tipping forces to which the crane might be subjected due to wind loads along the boom structure.

The windlock is designed primarily for storage purposes. It could be used to counter transverse forces during lifting of a load, but only in situations where the crane lifts a load in a stationary position. The windlock should be released whenever either transporter is being moved relative to the ground, since it is desirable that there be freedom of movement between the transporters to eliminate undesirable loading or binding between the various crane elements.

The present apparatus also includes a unique assembly for stabilizing the counterweight platform 21. While this assembly is shown on the counterweight load platform, it is to be understood that it could also be applied to the load platform 12 that supports boom 13.

The stabilizing assembly comprises four jacks normally freely suspended at the corners of the platform. The jacks are located slightly beyond the sweep of the tracks supporting the platform. They are individually controllable to support part or all of the weight of the platform in a level, non-binding manner.

Referring specifically to the drawings (FIGS. 2 through 5), the jacks are suspended from heavy rigid jacking beams 26 fixed at each side of the counterweight platform 21. The outer end of each jacking beam 26 includes a downwardly facing bearing surface 27 against which the jack mechanism is engageable.

Each jack includes a hydraulic jack cylinder 28 and moveable piston 29. The base of the cylinder 28 is fixed to an enlarged pedestal 30 having a bottom pad with sufficient surface area to support the full weight of the counterweight platform 21 in the terrain for which the crane assembly is designed.

The upper end of piston 29 is provided with a transverse hanger 31 mounted to the piston by means of a spherical bearing assembly 32. The bearing assembly 32 permits the jack to accommodate minor variations in the ground contour engaged by pedestal 30. Hanger 31 supports an upwardly facing bearing pad 33 complementary to the bearing surface 27 at the underside of jacking beam 26.

Each jack normally is suspended from the outer end of jacking beam 26 by chains 34. Each chain 34 extends between a fixed anchor bolt at the side of jacking beam 26 and a transverse outer end of hanger 31. The length of each chain 34 is such as to locate bearing pad 33 at a spaced position beneath bearing surface 27 when the jack is retracted.

To assure leveling of platform 21 while supported by the four jack assemblies, a three point jack support is provided through suitable hydraulic connections and controls. To achieve this, two of the jacks are connected in unison to a common fluid supply line so that they will be moved equal distances as a single unit. The remaining two jacks are individually controllable, completing the three "legs" of the support system. By individually controlling the three "legs" of the support system, one can accurately level platform 21 and prevent mechanical binding between it and the transporter frame 23 which it overlies.

The frictional bearing pad 33 at the top end of piston 29 and the mating bearing surface 27 at the underside of jacking beam 26 permit relative sliding movement between the jack assembly and platform 21. Such sliding movement is desirable during initial seating of these surfaces where the pedestal 30 engages a ground area not exactly horizontal. It is also important during pivoting of the transporter frame 23, since such pivoting movement might result in slight horizontal displacement of platform 21. Such displacement can be accommodated by relative sliding movement between pad 33 and surface 27 without binding of the pivotal connection or king pin assembly which connects transporter frame 23 to platform 21.

The jack assemblies are useful in permitting the transporter to be moved from beneath the platform when the platform is to remain in a stationary position, as during storage of the platform or during periods of nonuse. The jack assemblies are also useful in providing stability to platform 21 when the windlock between stinger 24 and platform 21 is engaged. Finally, by transferring most of the weight of platform 21 to the jack assemblies, rather than to the transporter frame 23, one can utilize the crawler tracks 22 to pivot transporter frame 23 beneath platform 21 without undue ground disturbance or displacement of platform 21. This is of particular importance in a crane assembly, where the tracks 22 must be pivoted between angular positions under platform 21 required to move the crane assembly and angular positions needed to move the counterweight unit about the forward boom assembly.

A second embodiment of the invention, incorporating a modified form of the stinger, is shown in FIGS. 9 through 11.

According to this second embodiment, stinger 50 is rectangular in cross section, and includes a pair of transversely spaced box frames 51 extending outwardly from an inboard yoke 52 which is pivotally connected to the load platform 12 at 53. The spaced box frames 51 are rigidly joined to yoke 52 and are rigidly spaced from one another by an interconnecting platform 54 which can be used as a support surface for the multiple winches required for operation of the crane assembly. The winches are generally indicated by reference numeral 55.

Extendable rectangular frames 56 are guided within the respective box frames 51 and are suitably supported by anti-friction rollers. The suspension of frames 56 permits their extension or retraction relative to the receiving box frames 51.

The outer ends of frames 56 are transversely joined by a rigid beam 57. The beam 57 slidably supports a longitudinal swivel tube 58, which is essentially similar to the previously described swivel tube 58 of the first embodiment. As shown in FIGS. 10 and 11, the outer end of swivel tube 58 includes a yoke 60 pivotally connected to the counterweight platform 21 by brackets 54 about a horizontal transverse axis at 69. The tube 58 is rotatably and slidably mounted within beam 57 by a pair of annular bearings 61. Swivel tube 58 has outer and inner shoulders 62 and 63 which respectively abut the bearings 61 at its limits of travel parallel to the stinger axis. The swivel tube 58 and yoke 60 connect the outboard end of stinger 50 to the counterweight platform 21 to permit freedom of movement between them about a transverse horizontal axis and both rotational and sliding relative movement along the center longitudinal axis of stinger 50.

The present windlock is provided on stinger 50 by means of two longitudinal extensions 64 at the extreme transverse sides of beam 57. The extensions 64 protrude outwardly from stinger 50 parallel to the stinger axis. They terminate in outer horizontal surfaces 65 engageable between screws 45 as previously described with respect to the first embodiment of the windlock.

The operation of the windlock in this second embodiment is identical to that previously discussed in detail. Again, the swivel tube 58 must be retracted within the stinger 50 so as to position the horizontal surfaces 65 between the upper and lower screws 45. The screws 45 can then be manually adjusted to engage these surfaces and lock stinger 50 so as to prevent relative rotational movement between the counterweight platform 21 and the stinger about the stinger central axis. It is also preferable that the telescoping stinger 50 be fully retracted when the windlock is deployed, so as to minimize torsional deflection along the length of stinger 50.

The present windlock can be employed on stingers of many different structural configurations. Their cross-sectional shape can be circular, square or rectangular, or can be fabricated from a combination of such shapes so as to structurally couple the two load platforms at the base of the crane assembly. The stinger structure can be made in one piece or in several pieces having interchangeability so as to permit variations in stinger length. The stinger can also be telescopic so as to permit length adjustment. Similarly, the booms, counterweight strut, and other crane elements of the invention can be of differing interchangeable length or can be telescopic.

This description of two preferred embodiments of the invention has been presented for purposes of illustration and example. It is not intended to be exhaustive or to limit the invention to the precise form disclosed. It is intended that the scope of the invention be defined by the following claims.

What is claimed is:

1. A counterbalanced crane structure, for operational use in lifting load requiring mobility; comprising:

first and second ground-supported mobile platforms;

an upwardly directed crane boom mounted to one of said first and second platforms;

counterbalance means mounted on the remaining one of said first and second platforms;

a rigid stinger having a longitudinal stinger axis;

means operably connected between one end of the stinger and the first ground-supported mobile platform for conjoint pivotal movement of the stinger and said first platform about the longitudinal stinger axis;

means operably connected between the remaining end of the stinger and the second ground-supported mobile platform for eliminating undesirable loading or binding between the first and second platforms and the stinger by permitting free relative pivotal movement between the stinger and second platform about the longitudinal stinger axis during operational use of the counterbalanced crane structure;

at least one stinger arm rigidly connected to said remaining end of the stinger and extending therefrom;

and releasable, adjustable locking means mounted on said second platform for adjustably and securely engaging said stinger arm to prevent relative pivotal movement between the stinger and second platform about the longitudinal stinger axis.

2. The counterbalanced crane structure of claim 1 wherein said remaining end of the stinger comprises rigid structural members terminating along substantially horizontal surfaces;

said releasable locking means comprising:

a plurality of vertically adjustable elements movably mounted to said second platform in the respective paths of said surfaces and adapted to engage and bear against them.

3. The counterbalanced crane structure of claim 2 further comprising:

means operably connecting said remaining end of the stinger to the second platform for permitting limited relative longitudinal movement between them along said longitudinal stinger axis, whereby said surfaces can be selectively located along the stinger axis at a location clear of said releasable locking means by varying the relative spacing between said first and second mobil platforms along the longitudinal stinger axis.

4. The counterbalanced crane structure of claim 3 wherein the means operably connecting said remaining end of the stinger to the second platform comprises:

a first cylindrical member having a central longitudinal axis coaxial with said longitudinal stinger axis;

a second cylindrical member slidably received within the first cylindrical member for relative movement between them along said longitudinal stinger axis;

and stop means on said first and second cylindrical members for limiting axial sliding motion of one relative to the other;

one of said cylindrical members being mounted to the second platform and the remaining member being mounted to the stinger.

5. The counterbalanced crane structure of claim 4 wherein the first cylindrical member is mounted to the stinger and the second cylindrical member is mounted to the second platform.

6. The counterbalanced crane structure of claim 1 further comprising: jack means on said second platform for selectively providing rigid ground support thereto.

* * * * *